US011332879B2

(12) United States Patent
Borgerding

(10) Patent No.: US 11,332,879 B2
(45) Date of Patent: May 17, 2022

(54) PINTLE INSERTION TOOL

(71) Applicant: ASTENJOHNSON INTERNATIONAL, INC., Charleston, SC (US)

(72) Inventor: Ted Borgerding, Dayton, OH (US)

(73) Assignee: ASTENJOHNSON INTERNATIONAL, INC., Charleston, SC (US)

( * ) Notice: Subject to any disclaimer, the term of this patent is extended or adjusted under 35 U.S.C. 154(b) by 51 days.

(21) Appl. No.: 17/052,740

(22) PCT Filed: Sep. 30, 2019

(86) PCT No.: PCT/US2019/053770

§ 371 (c)(1),
(2) Date: Nov. 3, 2020

(87) PCT Pub. No.: WO2020/076534

PCT Pub. Date: Apr. 16, 2020

(65) Prior Publication Data

US 2021/0180242 A1 Jun. 17, 2021

Related U.S. Application Data

(60) Provisional application No. 62/743,898, filed on Oct. 10, 2018.

(51) Int. Cl.

| | |
|---|---|
| ***D21F 7/10*** | (2006.01) |
| ***D06H 5/00*** | (2006.01) |
| ***D21F 1/00*** | (2006.01) |

(52) U.S. Cl.

CPC ..... *D06H 5/002* (2013.01); *D21F 1/0054* (2013.01); *D21F 7/10* (2013.01)

(58) Field of Classification Search

None

See application file for complete search history.

(56) References Cited

U.S. PATENT DOCUMENTS

| | | | |
|---|---|---|---|
| 3,576,055 | A | 4/1971 | Gisbourne |
| 4,451,957 | A | 6/1984 | Lefferts et al. |

(Continued)

FOREIGN PATENT DOCUMENTS

| | | | |
|---|---|---|---|
| FR | 2551105 | A1 | 3/1985 |
| WO | 1998-006894 | A1 | 2/1998 |

OTHER PUBLICATIONS

International Search Report, PCT/US2019/053770, dated Dec. 2, 2019, 2 pgs.

*Primary Examiner* — Alexander S Thomas

(74) *Attorney, Agent, or Firm* — Volpe Koenig

(57) ABSTRACT

In one embodiment, a pintle insertion tool is disclosed. The pintle insertion tool includes a housing, and a drive assembly supported by the housing. The drive assembly includes a controller connected to a power supply and configured to drive at least one motor. The drive assembly includes a first roller and a second roller defining at least a portion of a channel therebetween. The at least one motor is configured to rotate the first roller and the second roller in both a forward direction and a reverse direction. The channel is adapted to receive a pintle lead wire such that the pintle lead wire is driven by the first roller and the second roller through interdigitated seam loops on opposing ends of a textile sheet so that a pintle can be pushed into position to complete a seam.

14 Claims, 12 Drawing Sheets

(56) References Cited

U.S. PATENT DOCUMENTS

| | | | |
|---|---|---|---|
| 4,539,730 | A | 9/1985 | Romanski |
| 4,806,208 | A | 2/1989 | Penven |
| 5,117,542 | A | 6/1992 | Krenkel et al. |
| 5,791,383 | A | 8/1998 | Eckhardt |
| 7,086,128 | B2 | 8/2006 | Smith |
| 8,563,114 | B2 | 10/2013 | Manninen |
| 9,303,356 | B2 | 4/2016 | Manninen |
| 9,315,940 | B2 | 4/2016 | Lee |
| 9,358,752 | B2 | 6/2016 | Manninen |
| 9,587,351 | B2 | 3/2017 | Manninen |
| 9,593,450 | B2 | 3/2017 | Manninen |
| 2007/0028997 | A1 | 2/2007 | Best et al. |
| 2009/0050663 | A1 | 2/2009 | Ecker |
| 2012/0125476 | A1 | 5/2012 | Laukamp et al. |

PINTLE INSERTION TOOL

INCORPORATION BY REFERENCE

This application claims the benefit of U.S. Provisional Application No. 62/743,898 filed on Oct. 10, 2018, the contents of which are hereby incorporated by reference herein.

FIELD OF INVENTION

The present invention relates to an endless textile assembly, preferably a papermaking textile, and is more specifically directed to an insertion tool for a leader wire that is used to install a pintle to close a seam in order to render a textile sheet endless.

BACKGROUND

Closing a seam between free sheet ends is a well-known process, especially in the papermaking industry. Closing these seams often requires personnel to manually feed a pintle using a lead wire through interdigitated loops provided at textile sheet ends. Manually inserting the pintle through these loops can be time-consuming, inexact, and tedious. It is difficult and time consuming to feed the pintle through the loops manually and in alignment with the desired seam configuration. Additionally, papermaking machine textiles are relatively wide and require concentration by installation personnel for extended periods of time.

Accordingly, it would be desirable to provide an insertion tool that reliably and efficiently inserts a leader wire into loops so that a pintle can be easily installed.

SUMMARY

In one embodiment, a pintle insertion tool is generally disclosed that provides an improved arrangement for inserting a pintle into loops provided at opposing sheet ends.

In one embodiment, the pintle insertion tool includes a housing, and a drive assembly supported by the housing. The drive assembly includes a controller connected to a power supply and configured to drive at least one motor. The drive assembly includes a first roller and a second roller defining at least a portion of a channel therebetween. The at least one motor is configured to rotate the first roller and the second roller in both a forward direction and a reverse direction. The channel is adapted to receive a pintle lead wire with an attached pintle, with the first and second rollers engaging the pintle lead wire to drive it through the interdigitated seam loops so that the pintle can be pushed into position to close the seam.

In one embodiment, the drive assembly further comprises a gear set arranged between the at least one motor and the first and second rollers. In another embodiment, the gear set includes a reduction gear.

In another embodiment, the controller is a remote controller. The remote controller can have a wired or wireless connection to the drive assembly.

In one embodiment, the at least one motor includes a first motor and a second motor, and the first and second motors are adapted to be driven at an identical speed in opposite directions by the controller.

In one embodiment, the rollers are formed as wheels and include rubber contact surfaces adapted to engage the pintle lead wire.

In another embodiment, the housing is stationary. In another embodiment, the housing is portable and handheld.

In one embodiment, the power supply is a DC power source. In one embodiment, the power supply includes a battery pack.

In another embodiment, the at least one motor is a variable speed motor. In one embodiment, the at least one motor is drivable in a reversible direction.

In one embodiment, a method of inserting a pintle is disclosed. The method includes providing a pintle insertion tool comprising: a housing; and a drive assembly supported by the housing, the drive assembly including a controller connected to a power supply and configured to drive at least one motor. The drive assembly further includes a first roller and a second roller defining at least a portion of a channel therebetween. The at least one motor is configured to rotate the first roller and the second roller in both a forward direction and a reverse direction. The channel is adapted to receive a pintle lead wire with attached pintle.

The method includes positioning the pintle insertion tool adjacent to opposing sheet ends, each of the opposing sheet ends defining a plurality of loops. The method includes inserting a pintle lead wire into the channel defined by the pintle insertion tool, such that the pintle lead wire with attached pintle is driven through the plurality of interdigitated seam loops from the opposing sheet ends in order to close a seam.

In one embodiment, the pintle insertion tool is inactive during the positioning step, and the pintle lead wire is manually inserted into a subset of seam loops of the plurality of loops provided along the sheet ends. The pintle insertion tool is activated after the pintle lead wire is manually inserted into the subset of seam loops.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION

Figure 1:
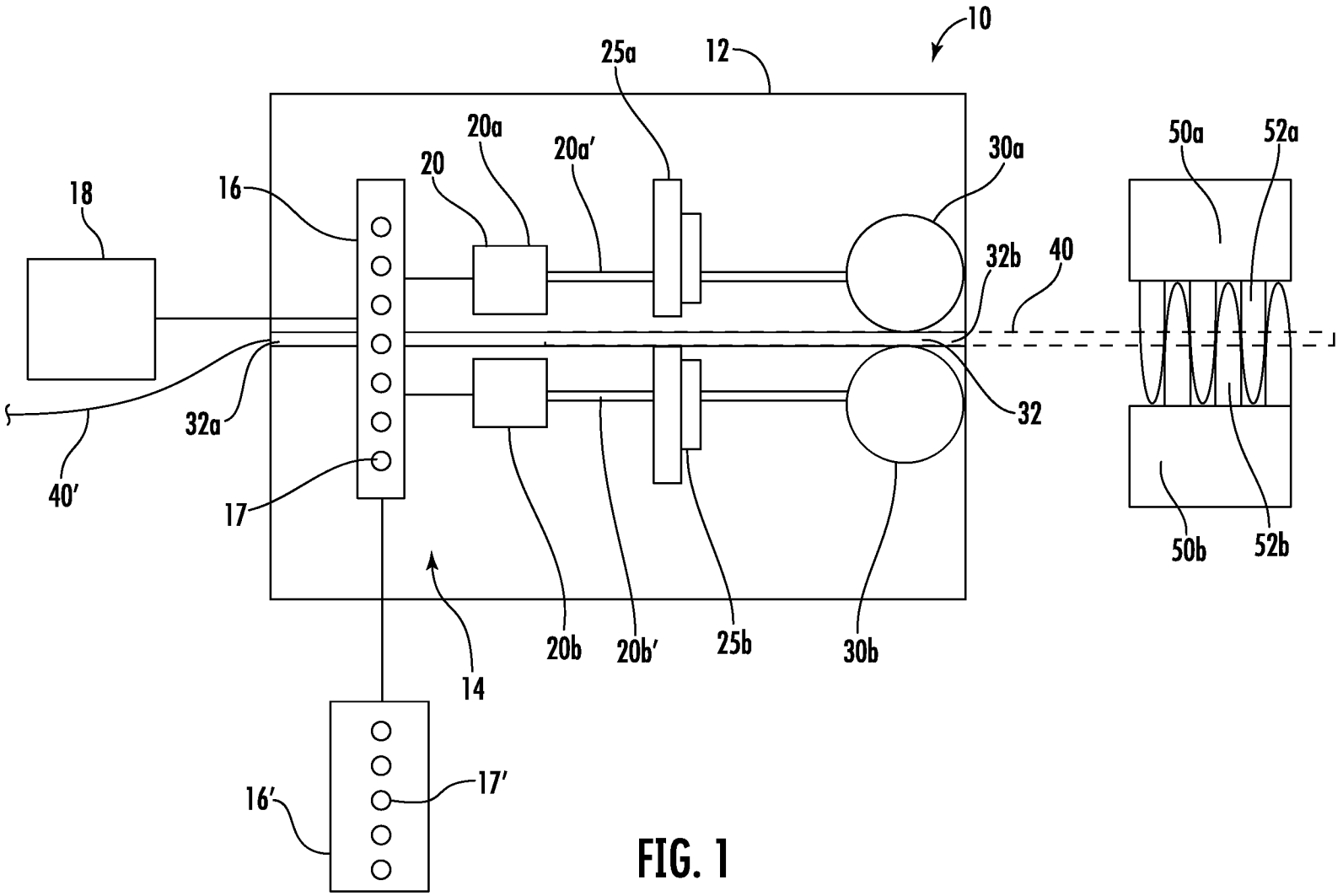
FIG. 1 is a schematic view of a pintle insertion tool.

Certain terminology is used in the following description for convenience only and is not limiting. In one embodiment, the textile according to the invention is an industrial textile, which can have many industrial applications, such as conveyor belts, filter fabrics, etc. In one arrangement, the textile is flat woven and seamed using seam loops provided at the warp ends in order to form a continuous belt. In another embodiment, the textile is flat woven and seamed using a separately formed seam element, such as a plastic film defining loops that is attached to a sheet end, in order to form a continuous belt.

One preferred application of the textiles is in a papermaking machine. The textile could have applications as a press fabric or a dryer fabric for use in the corresponding press or dryer sections of a papermaking machine. These are generally all referred to as a "papermaking fabric" regardless of the position of use in a papermaking machine.

Referring to FIGS. 1 and 2A-2G, a pintle insertion tool 10 is disclosed. The pintle insertion tool 10 includes a housing 12, and a drive assembly 14 supported by the housing 12. The housing 12 can include a mounting bracket 12' which can be used to mount the housing 12 relative to an underlying textile assembly. In one embodiment, the housing 12 is stationary. One of ordinary skill in the art would understand from the present application that the housing 12 can be modified such that it is mobile. In one embodiment, the housing 12 is mounted to a mobile installation cart, which can include wheels and casters for moving the housing 12 adjacent to textile sheet ends. In one embodiment, the tool 10 is mounted to the underlying textile assembly with clamps.

The drive assembly 14 includes a controller 16 connected to a power supply 18 and configured to drive at least one motor 20. In one embodiment, the power supply 18 is a DC power source. The power supply 18 can be portable and include a battery pack, or can include an AC-DC converter and a transformer in order to allow the use of AC line voltage. The power supply 18 can include any known type of power source.

A channel 32 is defined in the housing 12. The drive assembly includes a first roller 30*a* and a second roller 30*b* defining at least a portion of the channel 32 therebetween. As shown in FIG. 1, the channel 32 is defined continuously through the housing 12 and extends between the rollers 30*a*, 30*b*. The channel 32 size and dimensions can be selected to accommodate any variety of pintle lead wires, including varying leader wire configurations and associated monofilament or multifilament bundles for closing a seam.

In one embodiment, the channel 32 dimensions are adjustable, such that the channel 32 can be selectively sized by a user to accommodate varying pintle lead wires and filaments. In one embodiment, the rollers 30*a*, 30*b* directly contact each other. This configuration results in a pinching configuration in which any material traveling through the channel 32 is pinched by contact with each of the rollers 30*a*, 30*b*.

In one embodiment, shown in FIG. 1, an inlet 32*a* for the channel 32 is defined on a back face of the housing 12, and an outlet 32*b* for the channel 32 is defined on a front face of the housing 12. One of ordinary skill in the art would understand that alternative configurations for the channel 32 can be provided.

The at least one motor 20 is configured to rotate the first roller 30*a* and the second roller 30*b* in both a forward direction and a reverse direction. The channel 32 is adapted to receive a pintle lead wire 40 as well as an attached pintle. The motor 20 preferably provides a constant torque at varying speeds to rollers 30*a*, 30*b*.

The rollers 30*a*, 30*b* can be formed as identical rolling elements, defining a curved outer surface configured to engage the pintle lead wire 40. The rollers 30*a*, 30*b* can be formed from a compressible material, such that the rollers 30*a*, 30*b* are pinched together to define a narrow channel 32. In another embodiment, the rollers 30*a*, 30*b* are formed from a rubber material. In one embodiment, the rollers 30*a*, 30*b* include non-slip surfaces on the surfaces adapted to engage the pintle lead wire 40.

The term controller 16 as used herein can include any driver circuitry, CPU, processor, memory, switch, electronic components, input/output interface, etc. The controller 16 can include connection ports, communication lines, and any other type of connection configurations for transmitting and receiving an input and/or output. The controller 16 can include programmable settings for driving the pintle lead wire 40 at a predetermined speed or for a predetermined time based on characteristics of the associated textile/seam application.

The term motor 20 can include any known type of motor, such as an electric motor, brushless motor, etc. The motor 20 can include an output shaft or plurality of output shafts.

As shown in FIG. 1, in the preferred embodiment, two separate motors are used with the first motor 20*a* including an output shaft 20*a*' and the second motor 20*b* including an output shaft 20*b*'. Alternative types and arrangements of the motors, including multiple output shafts, can be used.

In one embodiment, the at least one motor 20 is also drivable in a reverse direction. In one embodiment, the at least one motor 20 is a variable speed motor. Speed controls for the motor 20 can be provided on the controller 16. Settings for the speeds can be selected based on the type of seam and or the type of textile that is being used in a specific application.

In one embodiment, the drive assembly 14 further comprises a gear set 25*a*, 25*b* arranged between the at least one motor 20 and the first and second rollers 30*a*, 30*b*. In another embodiment, the gear set 25*a*, 25*b* includes a reduction gear. The gear set 25*a*, 25*b* and reduction gear set allows for greater torque being output by the rollers 30*a*, 30*b* in a relatively compact overall housing.

In another embodiment, the controller 16 includes a remote controller 16'. A wired or wireless connection can be provided between the controller 16 and the remote controller 16'. In one embodiment, the remote controller 16' is a hand-held joystick-type controller. The controls for the remote controller 16' can include buttons 17' to control start/stop, forward and backward directions, power on/off switches, and multiple other buttons. The controller 16 can include buttons, controllers, and/or switches 17. In one embodiment, the controller 16 can include internet and/or Bluetooth connectivity.

In one embodiment, the first and second motors 20*a*, 20*b* are adapted to be driven at an identical speed in opposite directions by the controller 16. A regulator can be implemented to ensure both motors 20*a*, 20*b* are driven at exactly the same speed, as well as in a reverse direction. Alternative driving arrangements could be provided, such as arrangements including a single roller or more than two rollers.

In one embodiment, a monofilament or multifilament 40' is attached to the pintle lead wire 40. One of ordinary skill in the art would understand that the pintle lead wire 40 can include a variety of features or elements.

In one embodiment, a method of inserting a pintle lead wire 40 with an attached pintle 40' to close a seam in a textile assembly is disclosed. The method includes providing a pintle insertion tool 10. The pintle insertion tool 10 includes a housing 12. A drive assembly 14 is supported by the housing 12, and the drive assembly 14 includes a controller 16 connected to a power supply 18 and configured to drive at least one motor 20. The drive assembly 14 includes a first roller 30*a* and a second roller 30*b* defining a portion of a channel 32 therebetween. The at least one motor 20 is configured to rotate the first roller 30*a* and the second roller 30*b* in both a forward direction and a reverse direction. The channel 32 is adapted to receive a pintle lead wire 40 with attached pintle 40'.

The method includes positioning the pintle insertion tool 10 adjacent to opposing textile sheet ends 50*a*, 50*b*, which are currently not connected. Each of the opposing textile sheet ends 50*a*, 50*b* define a plurality of seam loops 52*a*, 52*b*. The seam loops 52*a*, 52*b* can be pre-formed loops attached to the textile sheet ends, or can be formed from back-woven warp yarns at the textile sheet ends.

The pintle insertion tool 10 can include an alignment feature, such as visible indicia (i.e. arrows, markings) for a user to align with the textile sheet ends 50*a*, 50*b* and seam loops 52*a*, 52*b*. Alternatively, an alignment tool or apparatus can be provided to help users align the tool 10 with the textile sheet ends 50*a*, 50*b*. In one embodiment, an alignment tool can include guidance systems or components, such as a laser guide apparatus.

Figure 2A:
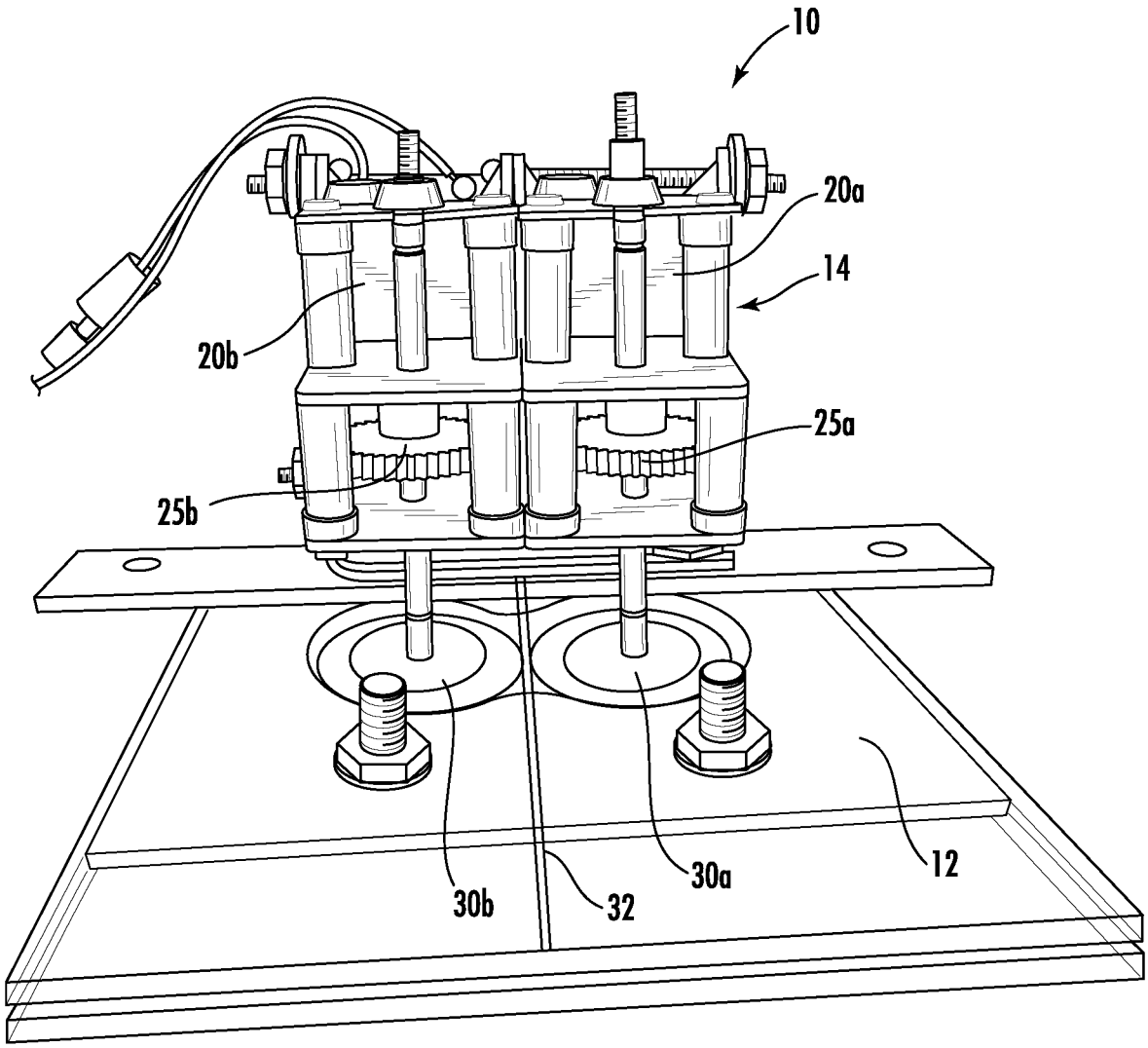
FIGS. 2A-2G illustrate varying perspective views of the pintle insertion tool of FIG. 1.
Figure 2B:
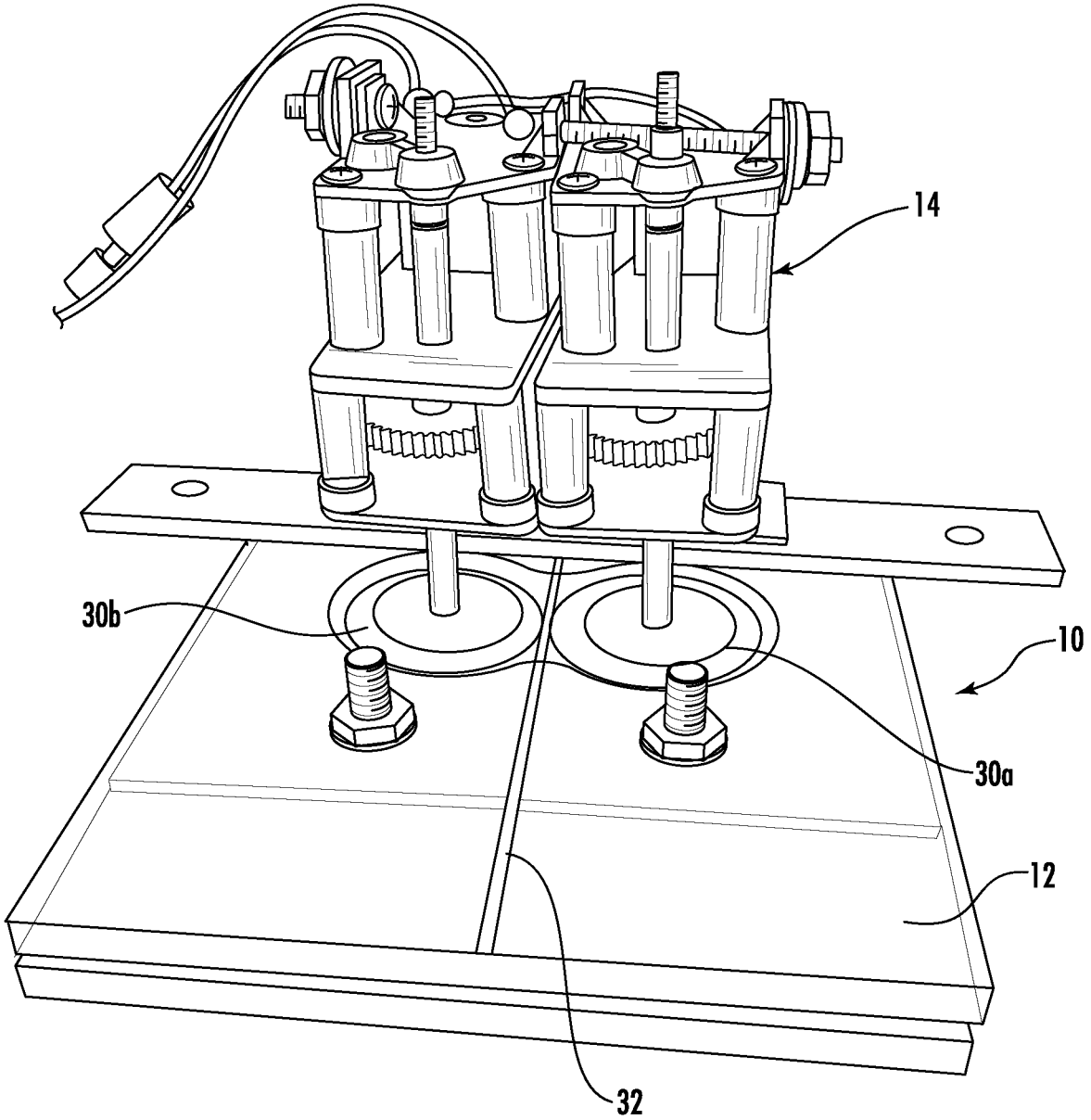
Figure 2C:
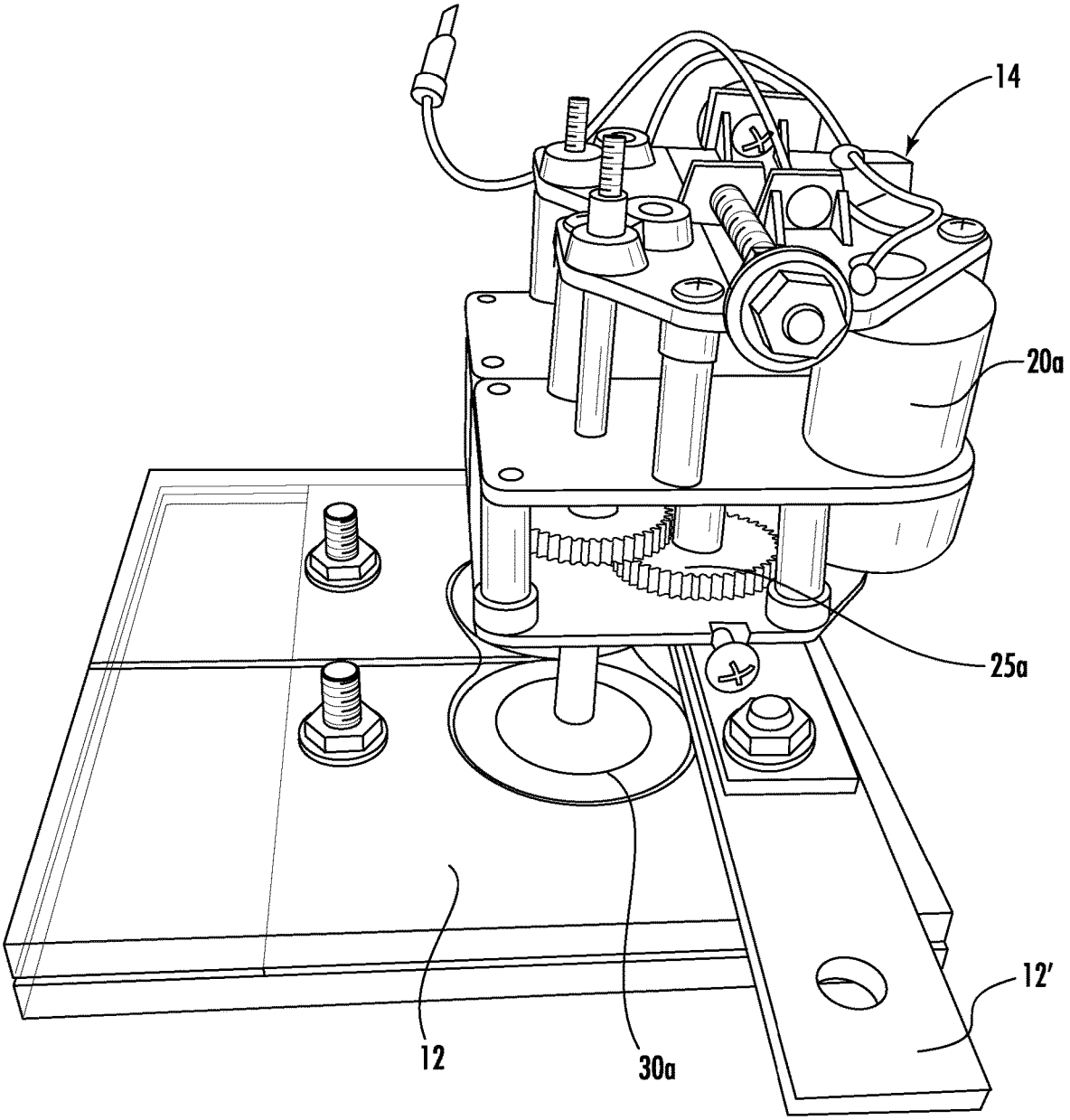
Figure 2D:
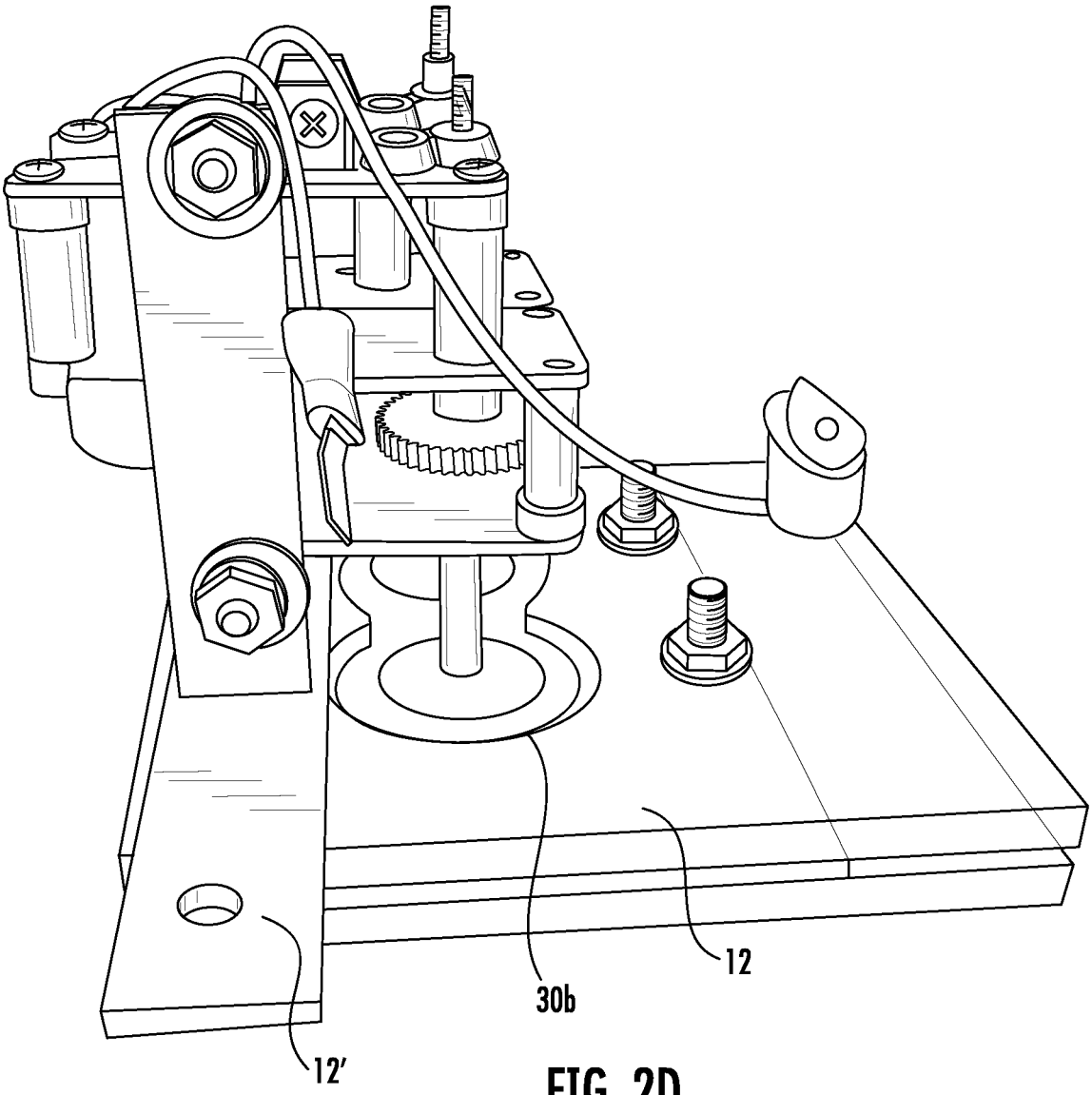
Figure 2E:
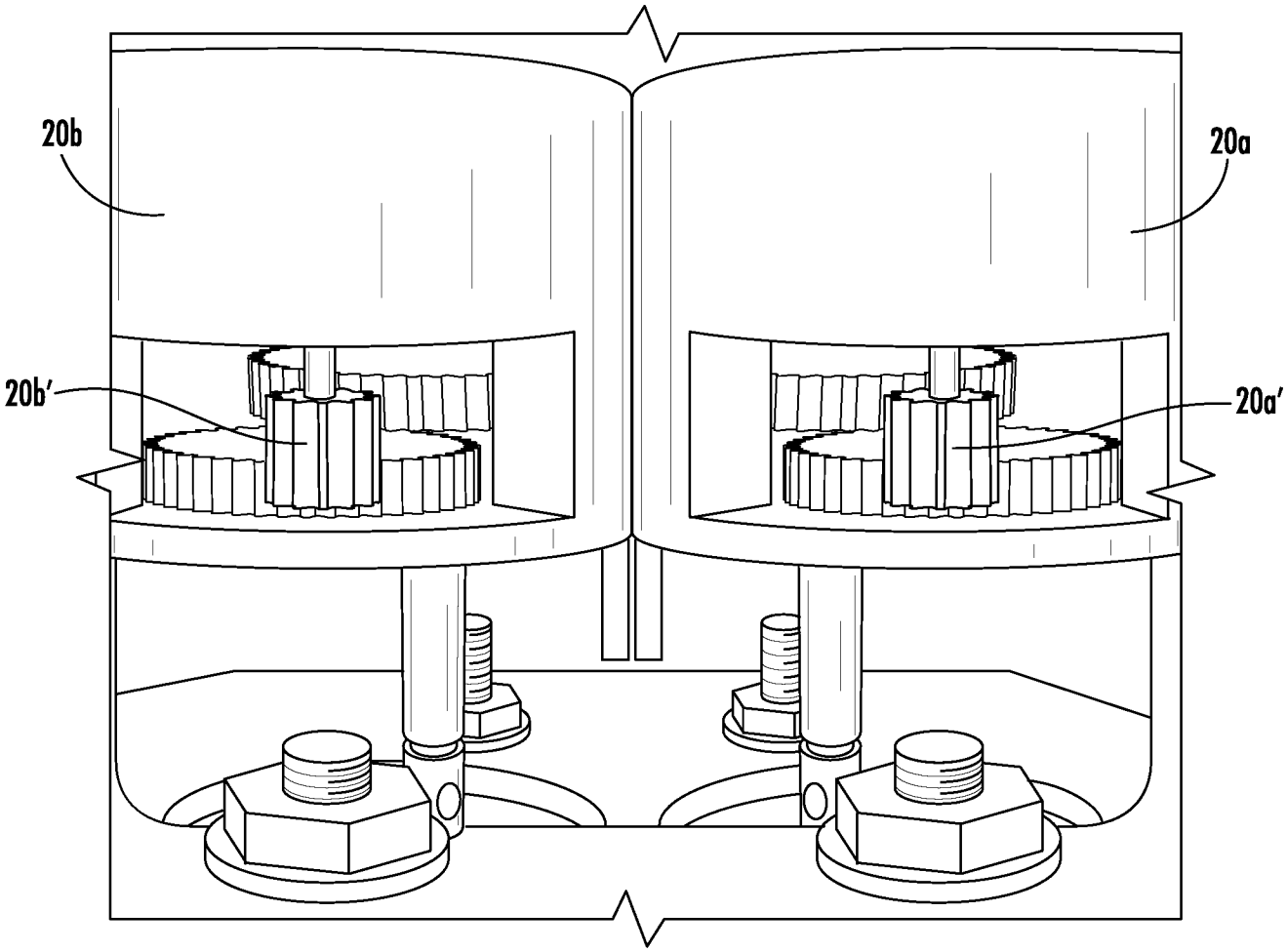
Figure 2F:
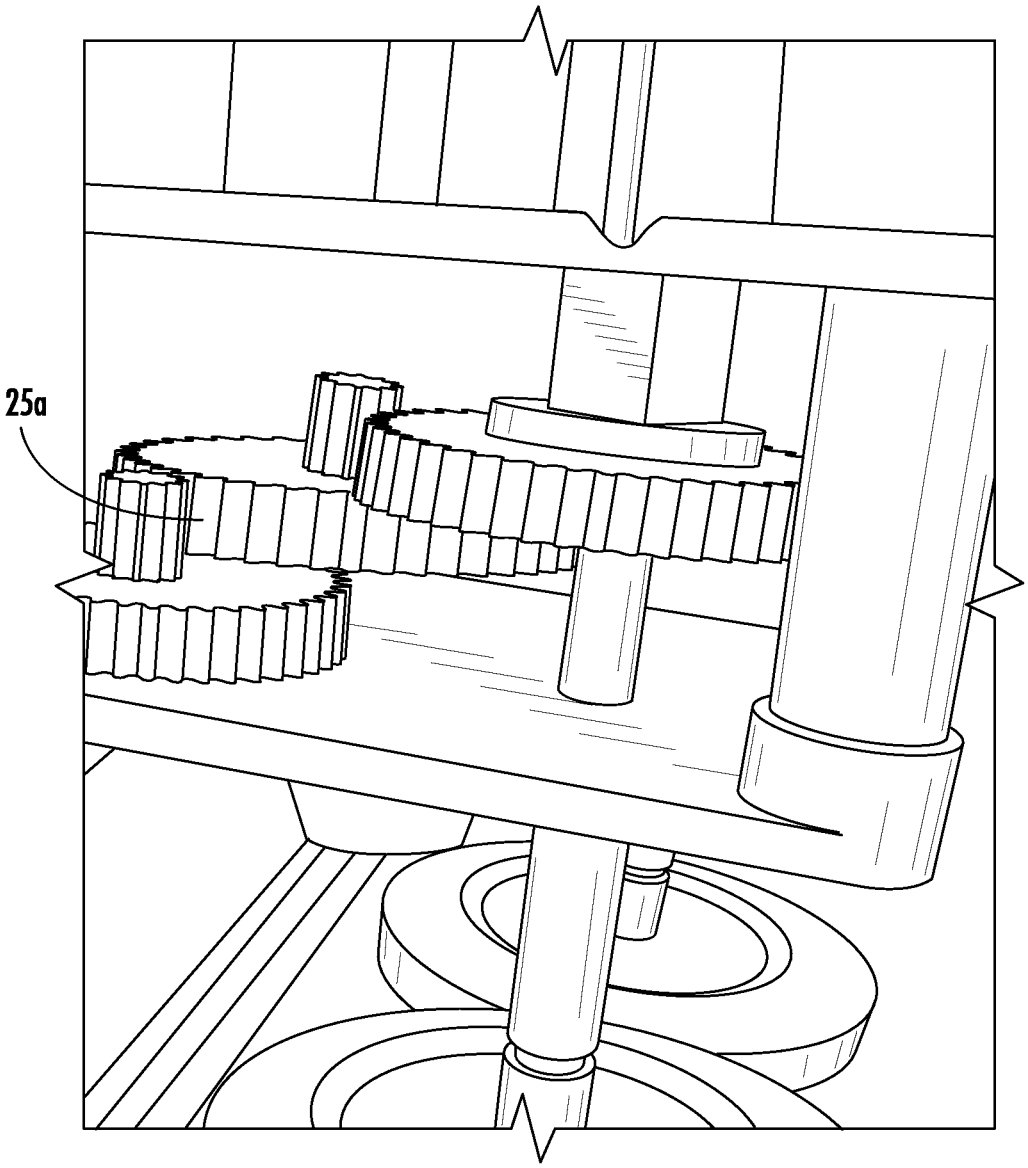
Figure 2G:
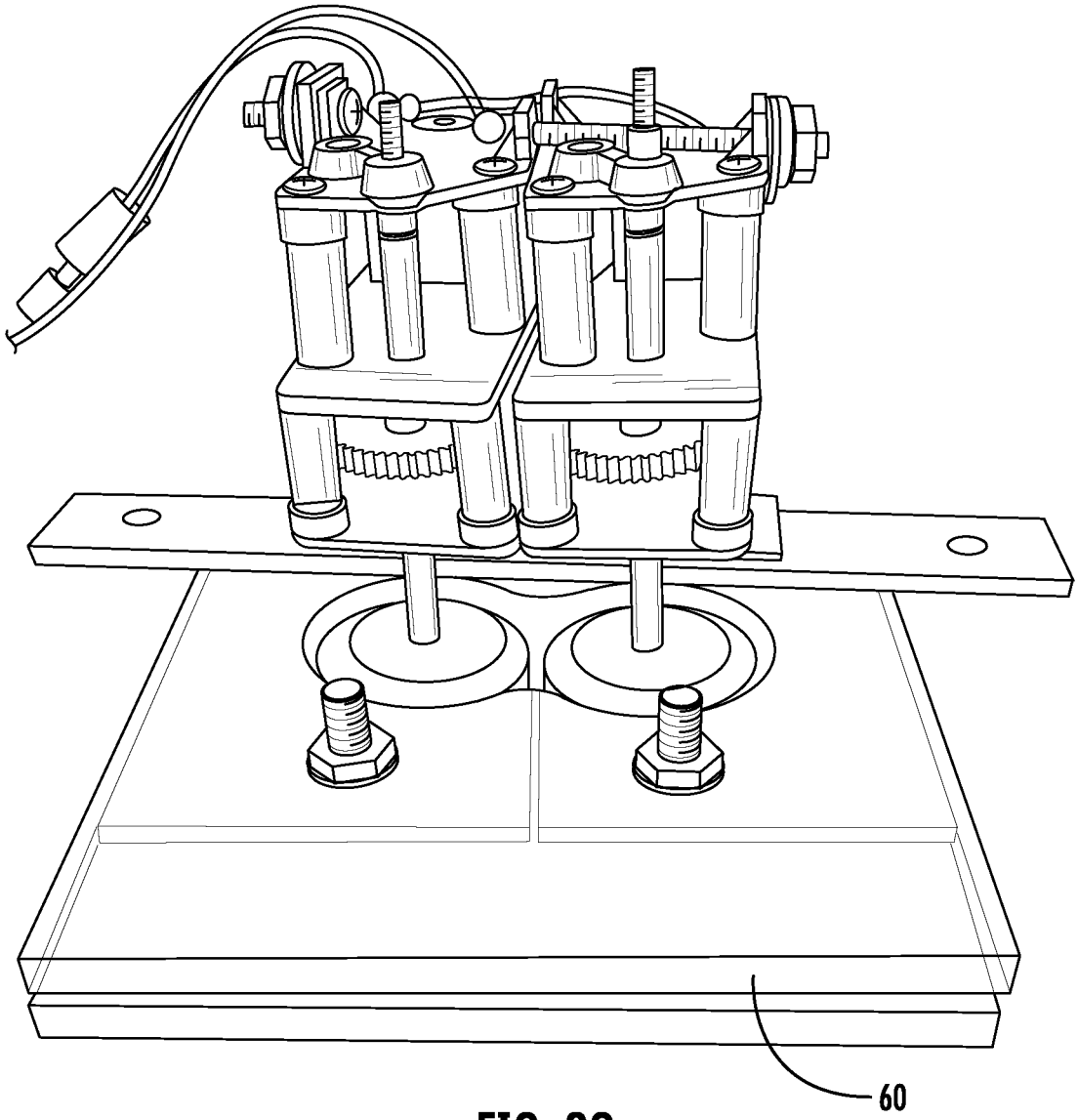

As shown in FIG. 2G, an alignment feature 60 is formed as a slit or groove of the housing 12. The alignment feature 60 can include clips, grips or mounting portions to receive ends of textiles and hold the ends in position during insertion of the pintle lead wire 40.

Figure 3A:
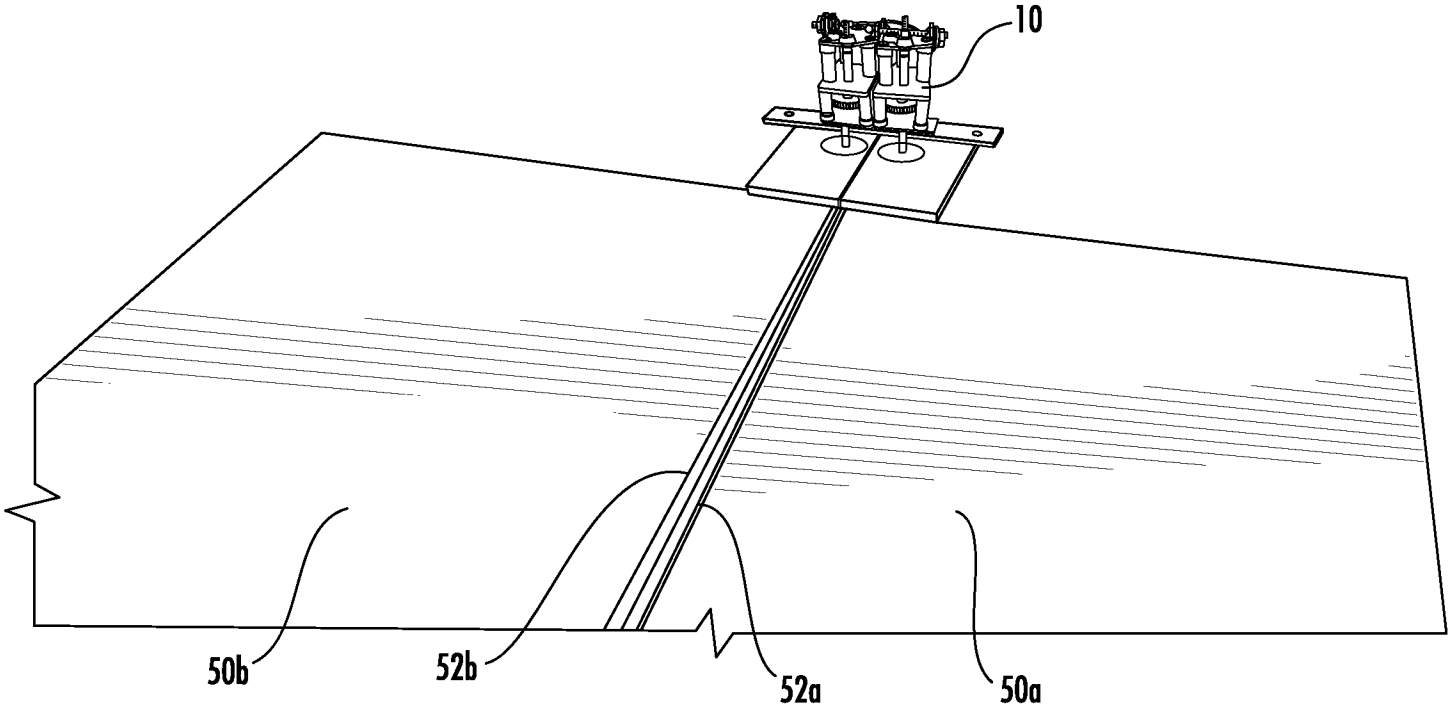
FIGS. 3A and 3B illustrate views of pintle insertion tool being used in association with closing a seam for sheet ends.
Figure 3B:
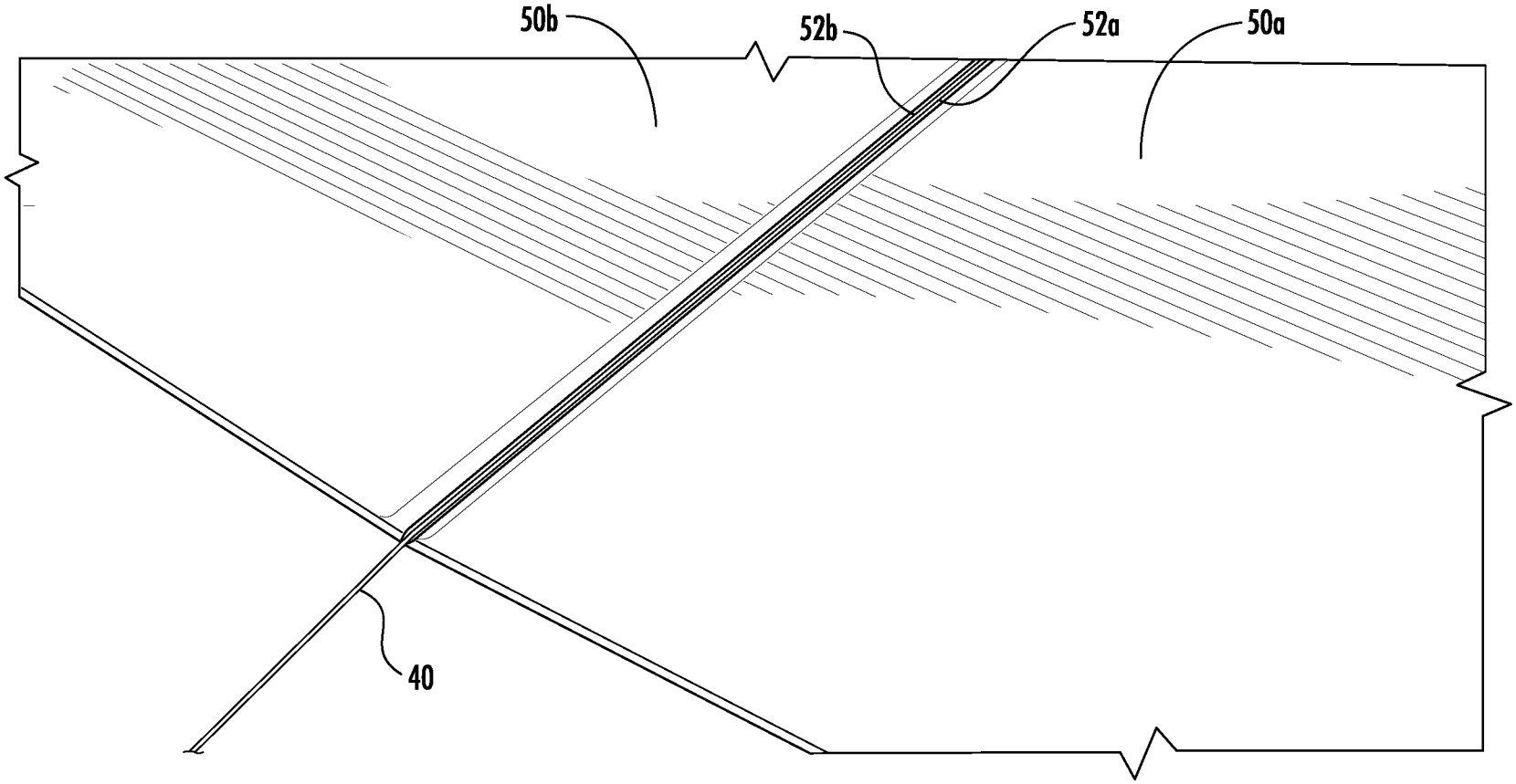

The method includes inserting a pintle lead wire 40 with attached pintle 40' into the channel 32 defined by the pintle insertion tool 10, such that pintle lead wire 40 is driven through the plurality of interdigitated seam loops 52*a*, 52*b* to close a seam between the opposing textile sheet ends 50*a*, 50*b*. Different stages of this insertion method are shown in FIGS. 3A and 3B.

In one embodiment, the method includes installation personnel manually inserting a leading edge of the pintle lead wire 40 into the loops while the tool 10 is off. Once the pintle lead wire 40 is partially inserted within at least a first sub-set of seam loops of the plurality of seam loops 52*a*, 52*b*, then the tool 10 is switched on, and the pintle lead wire 40 is driven towards and through all of the remaining interdigitated seam loops 52*a*, 52*b*.

In one embodiment, the rollers 30*a*, 30*b* rotate at a speed such that the pintle lead wire 40 has a feed rate of one foot per five seconds to one foot per second. One of ordinary skill in the art would understand that the feed rate of the pintle 40 into the loops 52*a*, 52*b* can be adjusted depending on the specific requirements of a particular application.

Although the insertion tool 10 is disclosed as being used for inserting a pintle lead wire 40, one of ordinary skill in the art would understand that the insertion tool 10 could also be used to insert a variety of other types of components, such as stuffers into spiral fabrics.

Figure 5:
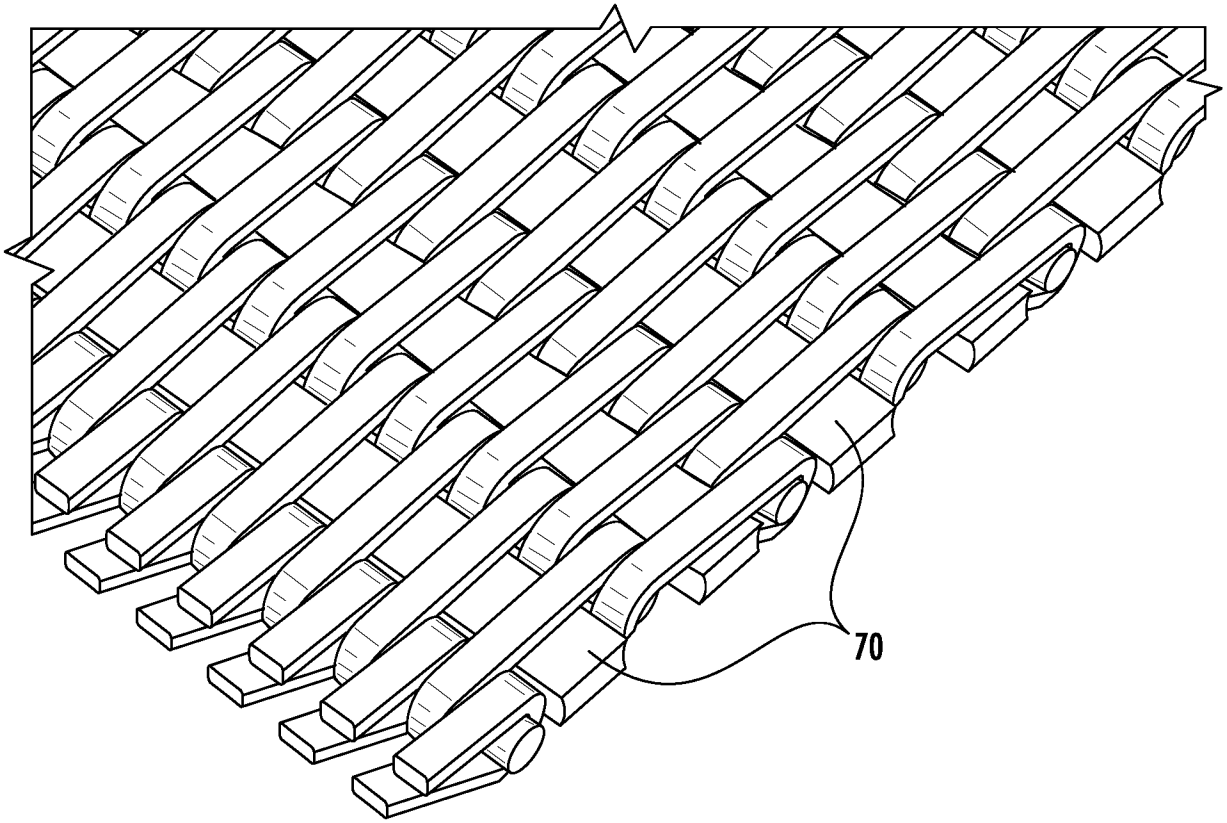
FIG. 5 illustrates an alternative embodiment in which the insertion tool is used.

As shown in FIG. 5, in one embodiment, stuffers 70 are inserted into aligned openings defined by textile bands or loops. The stuffers 70 can be inserted using the insertion tool 10 disclosed herein.

In one embodiment, an insertion tool is disclosed including a drive assembly having a controller connected to a power supply and configured to drive at least one motor. A first roller and a second roller define at least a portion of a channel therebetween. The at least one motor is configured to rotate the first roller and the second roller. The channel is adapted to receive a body such that the body is driven by the first roller and the second roller away from the drive assembly.

In one embodiment, the insertion tool is provided to generally drive a cylindrical body. In one embodiment, the cylindrical body is driven towards aligned openings. The channel of the housing is adapted to receive a cylindrical body such that the cylindrical body is driven by a first roller and a second roller.

Figure 4A:
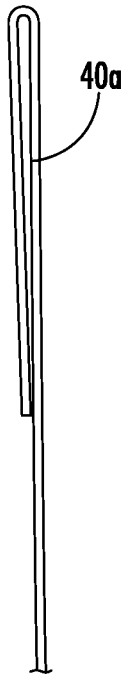
FIGS. 4A-4C illustrate views of a leader wire for a pintle.
Figure 4B:
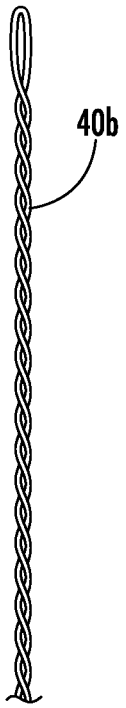
Figure 4C:
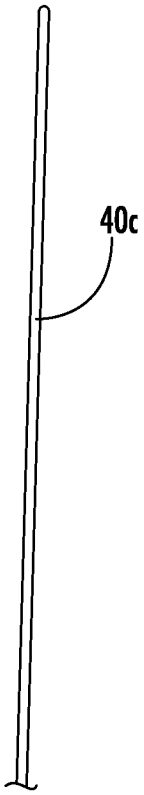

The pintle lead wire 40 used herein could include a leader wire 40*a*, 40*b*, 40*c* such as disclosed in FIGS. 4A, 4B, and 4C.

The pintle lead wire 40 can include the features disclosed in U.S. Patent Application 62/743,891, entitled "SEAM ASSEMBLY METHOD AND LEADER WIRE FOR SAME" which is owned by the same Assignee as the present application, and is incorporated herein by reference as if fully set forth.

One of ordinary skill in the art would understand that the shape, dimensions, profile, and other characteristics of the pintle lead wire can be altered depending on a specific requirement for a textile assembly.

Additionally, one of ordinary skill in the art would understand that the installation tool disclosed herein could be used in a variety of applications, and is not limited for use to industrial textile applications.

Having thus described the present invention in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A pintle insertion tool comprising:

a drive assembly including a controller connected to a power supply and configured to drive at least one motor, a first roller and a second roller defining at least a portion of a channel therebetween, the at least one motor configured to rotate the first roller and the second roller, and the channel is adapted to receive a pintle lead wire such that the pintle lead wire is driven by the first roller and the second roller through interdigitated seam loops on opposing ends of a textile so that a pintle can be pushed into position to complete a seam.

2. The pintle insertion tool of claim 1, wherein the drive assembly further comprises a gear set arranged between the at least one motor and the first and second rollers.

3. The pintle insertion tool of claim 2, wherein the gear set includes a reduction gear.

4. The pintle insertion tool of claim 1, wherein the controller is a remote controller.

5. The pintle insertion tool of claim 1, wherein the at least one motor includes a first motor and a second motor, and the first and second motors are adapted to be driven at an identical speed in opposite directions by the controller.

6. The pintle insertion tool of claim 1, wherein the drive assembly is supported by a stationary housing.

7. The pintle insertion tool of claim 1, wherein the power supply is a DC power source.

8. The pintle insertion tool of claim 1, wherein the at least one motor is a variable speed motor.

9. The pintle insertion tool of claim 1, wherein the at least one motor is drivable in both a forward direction and a reverse direction.

10. A method of inserting a pintle, the method comprising:

(i) providing a pintle insertion tool comprising:

a drive assembly including a controller connected to a power supply and configured to drive at least one motor, a first roller and a second roller defining at least a portion of a channel therebetween, the at least one motor configured to rotate the first roller and the second roller, and the channel is adapted to receive a pintle lead wire;

(ii) positioning the pintle insertion tool adjacent to opposing sheet ends, each of the opposing sheet ends defining a plurality of seam loops; and (iii) inserting a pintle lead wire into the channel defined by the pintle insertion tool, such that pintle lead wire is driven through the plurality of seam loops which are interdigitated to install a pintle to close a seam between the opposing sheet ends.

11. The method of claim 10, wherein the drive assembly further comprises a gear set arranged between the at least one motor and the first and second rollers, and the gear set includes a reduction gear.

12. The method of claim 10, wherein the at least one motor is a variable speed motor, and the at least one motor is drivable in a reversible direction.

13. The method of claim 10, wherein the at least one motor includes a first motor and a second motor, and the first and second motors are adapted to be driven at an identical speed in opposite directions by the controller.

14. The method of claim 10, wherein the pintle insertion tool is inactive during step (ii), the pintle lead wire is manually inserted into a subset of seam loops of the plurality of loops provided along an outermost edge of the sheet ends during step (ii), and the pintle insertion tool is activated after the pintle lead wire is manually inserted into the subset of seam loops.

* * * * *